US005733596A

United States Patent [19]

Arrington

[11] Patent Number: 5,733,596

[45] Date of Patent: Mar. 31, 1998

[54] PROCESS FOR CONTINUOUSLY APPLYING A WATER-BASED FILLER MATERIAL TO A SUBSTRATE

[75] Inventor: Donald L. Arrington, Dry Prong, La.

[73] Assignee: Willamette Valley Company, Eugene, Oreg.

[21] Appl. No.: 584,822

[22] Filed: Jan. 11, 1996

Related U.S. Application Data

[63] Continuation of Ser. No. 318,066, Oct. 5, 1994, abandoned.

[51] Int. Cl.[6] ..... B05D 1/26; B05D 3/02; B05D 7/06

[52] U.S. Cl. ..... 427/8; 427/280; 427/284; 427/317

[58] Field of Search ..... 427/8, 280, 284, 427/317; 1118/50, 271, 407, 410

[56] References Cited

U.S. PATENT DOCUMENTS

| | | | |
|---|---|---|---|
| 2,378,244 | 6/1945 | Pfenning | 144/309 |
| 2,616,824 | 11/1952 | Meiler | 154/116 |
| 3,428,508 | 2/1969 | Quick | 156/307 |
| 3,967,581 | 7/1976 | Zirbel | 118/2 |
| 4,070,509 | 1/1978 | Garner | 427/385.5 |
| 4,521,495 | 6/1985 | Hahn, Jr. | 428/537.1 |
| 4,587,288 | 5/1986 | Maxson et al. | 524/425 |
| 4,589,950 | 5/1986 | Sekavec, Jr. | 156/578 |
| 4,806,590 | 2/1989 | Padget et al. | 524/568 |
| 4,818,604 | 4/1989 | Tock | 428/319.9 |
| 4,853,061 | 8/1989 | Leung | 156/216 |
| 5,130,173 | 7/1992 | Barten | 427/314 |
| 5,141,784 | 8/1992 | Beane et al. | 427/419.8 |
| 5,160,766 | 11/1992 | Waltrip | 427/384 |
| 5,234,519 | 8/1993 | Talbot | 156/212 |
| 5,256,227 | 10/1993 | Roelofs | 156/157 |
| 5,290,598 | 3/1994 | Myers | 427/384 |
| 5,308,657 | 5/1994 | Markusch | 427/284 |

*Primary Examiner*—Shrive Beck
*Assistant Examiner*—Fred J. Parker
*Attorney, Agent, or Firm*—Marger Johnson McCollom & Stolowitz, P.C.

[57] ABSTRACT

A process is provided for continuously applying a substantially uniform and smooth filler of a water-based filler material to underlying wood substrates. The process comprises introducing the underlying wood substrates into a filler application area. Then, the initial temperature of the outer surface of the underlying wood substrates is determined. Prior to applying the water-based filler material, the initial temperature of said water-based filler material is determined. Prior to applying same to said underlying wood substrates, the initial temperature of the water-based filler material is continuously adjusted, based on the initial temperature of the underlying wood substrate, so that the final temperature of the water-based filler material of the outer surface of the underlying substrate is maintained. The water-based filler material is continuously applied to the outer surface of the underlying wood substrates in the filler application area. Underlying wood substrates that are substantially uniformly and smoothly coated with said water-based filler material are formed by this process.

29 Claims, 4 Drawing Sheets

PROCESS FOR CONTINUOUSLY APPLYING A WATER-BASED FILLER MATERIAL TO A SUBSTRATE

This is a Continuation of application Ser. No. 08/318,066 filed Oct. 5, 1994, now abandoned.

BACKGROUND OF THE INVENTION

The present invention is directed to a process for continuously applying a filler material to a substrate, and more particularly, to a process for applying a water-based filler material to a wood product board substrate.

Coated wood products employing filler materials are typically used in industries such as the furniture industry. Presently, a filler material application process is commercially conducted using a solvent-based filler, such as an acetone-based putty material. A thin layer of the solvent-based filler material is applied at a constant temperature to a heated wood board substrate. The constant temperature of the solvent-based filler material is achieved by heating drums of the material for up to a 48-hour period. The solvent is then flashed off as a vapor. However, the emission of these solvent vapors causes an environmental problem for workers in the filler application area.

Water-based filler materials are more environmentally acceptable than their solvent-based counterparts. Some water-based glues have been applied to wood substrates. For example, U.S. Pat. No. 5,234,519 to Talbot et al. discloses the application of a veneer to particle board, including use of a preheated substrate and a water-based glue. The glue is applied to the veneer by a roller applicator, and the glue is dried by fans and infrared radiation. U.S. Pat. No. 3,428,508 to Quick et al. refers to edge-gluing of lumber, wherein the boards are heated and a heat-cured adhesive is applied. The heat-cured adhesive cures as the board cools. U.S. Pat. No. 4,853,061 to Leung discloses a water-based urethane adhesive for use, e.g., on particle board. U.S. Pat. No. 5,256,227 to Roelofs describes the splicing of an endless belt accomplished by the use of a water-based adhesive with heat application to avoid use of adhesives which emit organic volatiles on curing.

U.S. Pat. No. 5,130,173 discloses preheating of a solvent-containing paint and an underlying substrate to which it is applied to reduce drying time. U.S. Pat. Nos. 4,070,509, 5,160,766 and 5,290,598 are directed to high-solids solvent-based filler compositions which reduce solvent content. U.S. Pat. Nos. 5,141,784 and 5,308,657 describe various water-based compositions for wood; the compositions of the latter patent are intended for filler furniture board edges. U.S. Pat. No. 4,521,495 refers to flooding the surface of a preheated wood substrate with an aqueous filler material, partially dewatering the filler material, affirming the filler to the surface by coalescence, and then removing the excess filler with an air knife.

In the application of a water-based filler material to an underlying wood substrate, it can take up to 30 minutes to flash off the water phase of a water-based filler material if the formation conditions are not carefully controlled during the filler operation. Also, the application temperature of the wood board substrate continually changes during the filler formation process. This is not a problem in solvent-based systems since the solvent has such a relatively low flash point. However, since water has a much higher flash point, instantaneous removal of moisture from the substrate filler has proven to be a significant hindrance to continuous commercial operation. If the requisite application temperature is not maintained within the designated operating range during the filler operation in the application area, flow problems will occur with the filler material which will impede the continuous application process.

After completion of the filler process, the coated boards should remain tack-free and exhibit a high degree of surface smoothness. If the coated boards are tacky, they will undergo blocking, i.e., they will stick together when stacked during storage. Tackiness is caused to a significant extent by the presence of excess moisture in the filler material after its application to an underlying substrate. Typically, this is due to insufficient vaporization of water vapor during the filler application process. A high degree of surface smoothness must also be maintained in the final product. This property is affected by excess shrinkage of the filler material in the application area which results in unwanted dips or dents being formed in the outer surface of the filler material.

Accordingly, there are presently no known continuous commercial filler operations of the type described above which employ water-based materials, particularly wood-based filler materials. A need therefore exists for a continuous process for applying a water-based filler material to a wood board substrate in which the water phase will rapidly flash off the water-based filler material, and wherein the temperature of the filler material can be adjusted to conform to the temperature of the wood board substrates even though the temperature of the wood board substrates continually change during the course of the filler formation process, the product coated board substrate being tack-free and having the desired degree of surface smoothness.

SUMMARY OF THE INVENTION

The above-described need has now been met by the process of the present invention. The subject process relates to continuously applying a substantially uniform and smooth filler of a water-based filler material to underlying wood substrates. The process comprises providing underlying wood substrates having an outer surface on which the water-based filler material is applied. Although most primary lumber substrates can be employed in the subject process, it is preferred that the underlying wood substrate comprise a composite wood product, and more preferably, that the underlying composite wood product comprise a product such as particleboard, oriented strandboard, plywood, or waferboard. In the preferred form of this invention, a lower grade wood substrate can be upgraded through the application of the filler material which acts to coat the outer surface thereof giving the appearance of a higher grade wood product.

The underlying wood substrates described above are first introduced into a filler material application area where a water-based filler material is applied thereto. The wood substrates typically have been heated at a point in the process prior to entering the application area and prior to applying the water-based filler material. Typically, in the wood products industry, the wood substrates are manufactured employing equipment which applies high temperature and pressure thereto. The equipment predominantly used for this purpose is known as a hot press. The wood substrate formation is conducted using the hot press equipment under relatively high temperature and pressure conditions, as high as 350 degrees F. Therefore, the temperature of the outer surface of these underlying wood substrates after completion of the formation process will generally be increased to an initial temperature. Although the initial temperature can be ambient temperature, it is typically higher depending on the formation conditions under which the wood substrates are produced. Typically, the initial temperature of the outer surface of the underlying substrate is from about 65 up to 210 degrees F., more preferably from about 70 up to 200 degrees F., and most preferably from about 75 up to 175 degrees F.

The initial temperature of the water-based filler material is also determined prior to applying same to the underlying wood substrates. The initial temperature is generally ambient temperature. Typically, the temperature of the outer surface of the underlying substrate is from about 75 up to 135 degrees F., more preferably from about 80 up to 125 degrees F., and most preferably from about 85 up to 120 degrees F.

However, the initial temperature of the water-based filler material must be continually adjusted based on the initial temperature of the underlying wood substrate. In this way the final temperatures of the water-based filler material as applied to the outer surface of the underlying substrate will be maintained within a temperature range which will facilitate the continuous application of the water-based filler material to the underlying substrate by flowing smoothly and thereby evenly coating the underlying substrate, preferably in a coating single pass.

In the process of the present invention, the temperature of the filler material is continually adjusted based on the initial temperature of the underlying wood substrate, the filler material will evenly flow over the outer surface of the underlying substrate filling the contours of the outer surface and forming a smooth outer layer of substantially uniform minimum thickness. In fact, the subject process will preferably allow changes in the temperature of the underlying substrate to be rapidly handled by correspondingly changes in temperature of the water-based filler material. Thus, the water-based filler material is continuously applied to the outer surface of the underlying wood substrates in the filler application area wherein both are maintained at the requisite predetermined temperature level and, accordingly, the underlying wood substrates are substantially uniformly smoothly coated with the water-based filler material. The manner of rapidly increasing the temperature of the filler material is through the use of a heat source, preferably a heater hose used to maintain the desired temperature of the filler material for application. In use, the heater hose typically is employed to transport the filler material to the surface of the underlying substrate. The temperature of the filler material can be rapidly and accurately adjusted as the filler material is transported through the heater hose so that filler material heated to the requisite temperature will exit the heater hose and will be directly applied to the surface of the underlying substrate.

Therefore, the requisite application temperature is maintained within the designated operating range during the filler dispensing operation in the application area when the subject process is employed as described above. In this way, the aforementioned flow and coating problems will not occur with the filler material which will impede the continuous application process thereof to the underlying substrate. The final temperature of the water-based filler material, during application to the underlying wood substrate, will preferably be from about 85 up to 200 degrees F., more preferably from about 90 up to 180 degrees F., and most preferably from about 95 up to 160 degrees F.

The water-based filler material is typically a water-based putty material. A preferred water-based putty material composition comprises calcium carbonate, ground lignocellulose, a polymeric emulsion, and water. Other additive materials may include defoamers, pigments, dispersants, biocides and glycol ethers. For example, a preferred composition for use as a water-based putty material is, based on the weight percent of the respective individual components, from about 70% to 80%, and more preferably about 75% of calcium carbonate, from about 1% to 5%, and more preferably about 3% ground lignocellulose, typically in the form of wood flour, from about 5% to 10%, and more preferably about 7% of a polymeric emulsion, such as an acrylate, from about 5% to 15%, and more preferably about 10% water, and from about 3% to 10%, and more preferably about 5% of additives including materials such as those described above.

Unlike solvents based filler materials which can have a relatively lower total solids (less than about 70% by weight) because the solvent portion of the composition will more readily instantaneously flash off, as we discussed above, the same is not the case with water-based filler materials wherein the water can take up to 30 minutes to be evaporated. This has been a problem in the past and is a major reason why water-based filler materials are not in common use. However, in the process of the present invention, a maximum total solids range is provided in subject water-based filler materials. Thus, the total solids of the water-based filler materials of the present invention is preferably at least about 70% by weight, based on the total weight of the filler material, more preferably at least about 75% by weight, based on the total weight of the filler material, and most preferably at least about 80% by weight, based on the total weight of the filler material.

The water-based filler material in the application area should have a minimum viscosity to avoid sag or shrinkage of the water-based filler material on the underlying substrate. The term "Brookfield Viscosity" for purposes of this invention is the viscosity of the filler material measured with a Brookfield Synchro-Lectric viscometer, Model RVT with a "D" spindle, at 2.5 RPM and a descending platform at 77 degrees F.±1 degree F., and having a total solids of 74 weight % ±1.5%. Under the aforementioned conditions, the Brookfield Viscosity of the water-based filler material is preferably at least about 100,000 cps, more preferably at least about 115,000 cps, and most preferably at least about 130,000 cps.

The filler material is preferably applied to the underlying substrate so that coverage is thin and smooth. If the filler material is too cool, the filler material will exhibit a grainy uneven appearance on the underlying substrate. It the filler material is too hot, sag and shrinkage will increase and the requisite degree of smoothness will diminish. If the continuous process of this invention is employed, however, the above problems will be substantially eliminated since temperature can be effectively controlled. Preferably, the layer of filler material applied to the underlying substrate will be substantially uniform and cover the entirety of the underlying to which it is applied, preferably at a thickness of up to about 28 wet mils, more preferably a thickness of up to about 14 wet mils, and most preferably a thickness of up to about 10 wet mils. The term "wet mils" is defined as the thickness of the filler material immediately after application and prior to substantial drying thereof.

After completion of the filler application process, the dried coated boards remain substantially tack-free. Thus, the substantially uniformly and smoothly coated underlying wood substrates can be stacked without substantial blocking. For example, stacking of the finished edge coated underlying substrates can preferably be accomplished within about 10 seconds, more preferably within about 30 seconds, and most preferably within about 60 seconds after the application step to the edge of the underlying substrate is completed, without substantial blocking.

A high degree of surface smoothness is maintained in the outer surface of the final product. This is the case since substantial shrinkage of the filler material is avoided. Therefore, significant amounts of unwanted dips or dents are not formed in the outer surface of the filler material and substantially uniformly and smoothly coating of the underlying substrate by the water-based filler material is achieved.

DETAILED DESCRIPTION OF A PREFERRED EMBODIMENT

Figure 1:
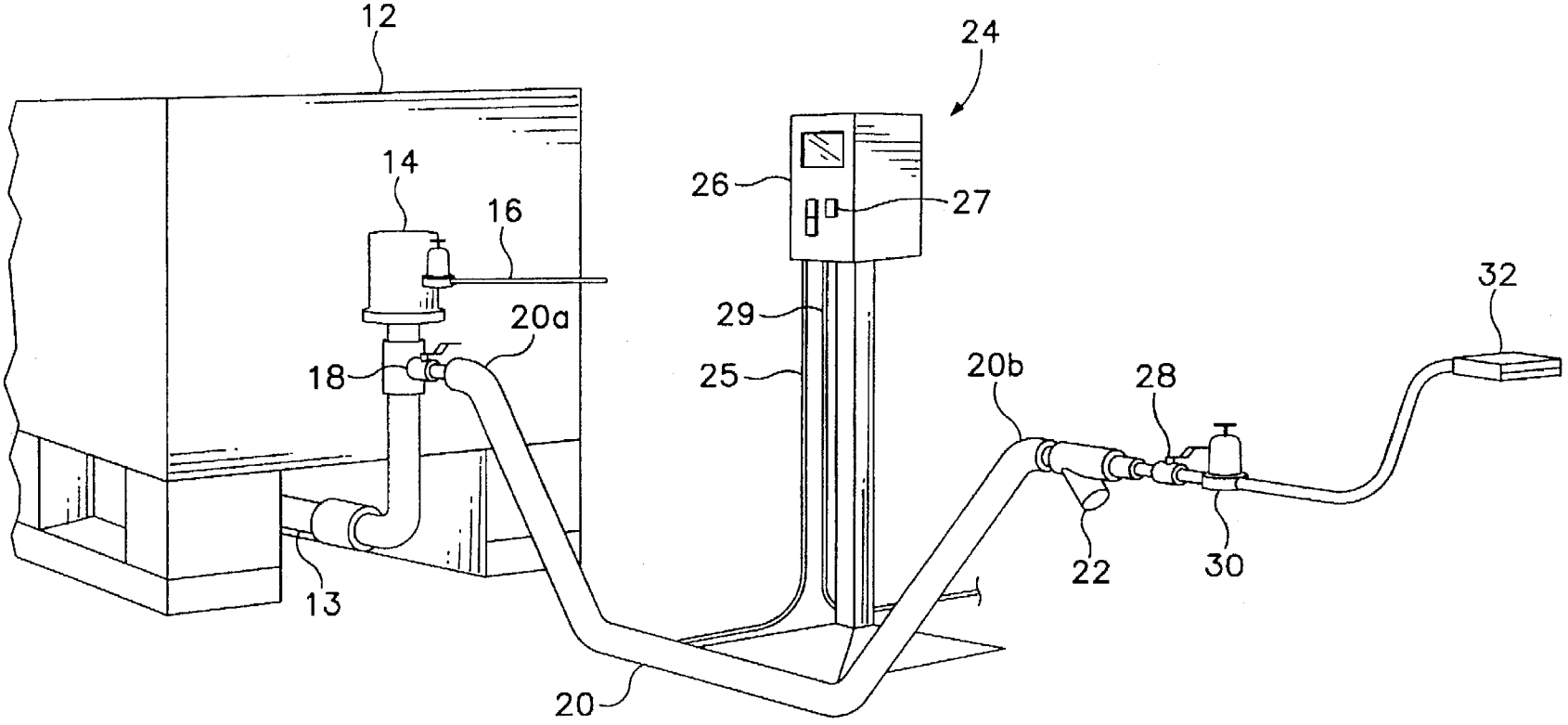
FIG. 1 is a schematic perspective representation of a system for continuously providing a water-based filler material from container 12 to applicator head 32 at the requisite application temperature.
Figure 2:
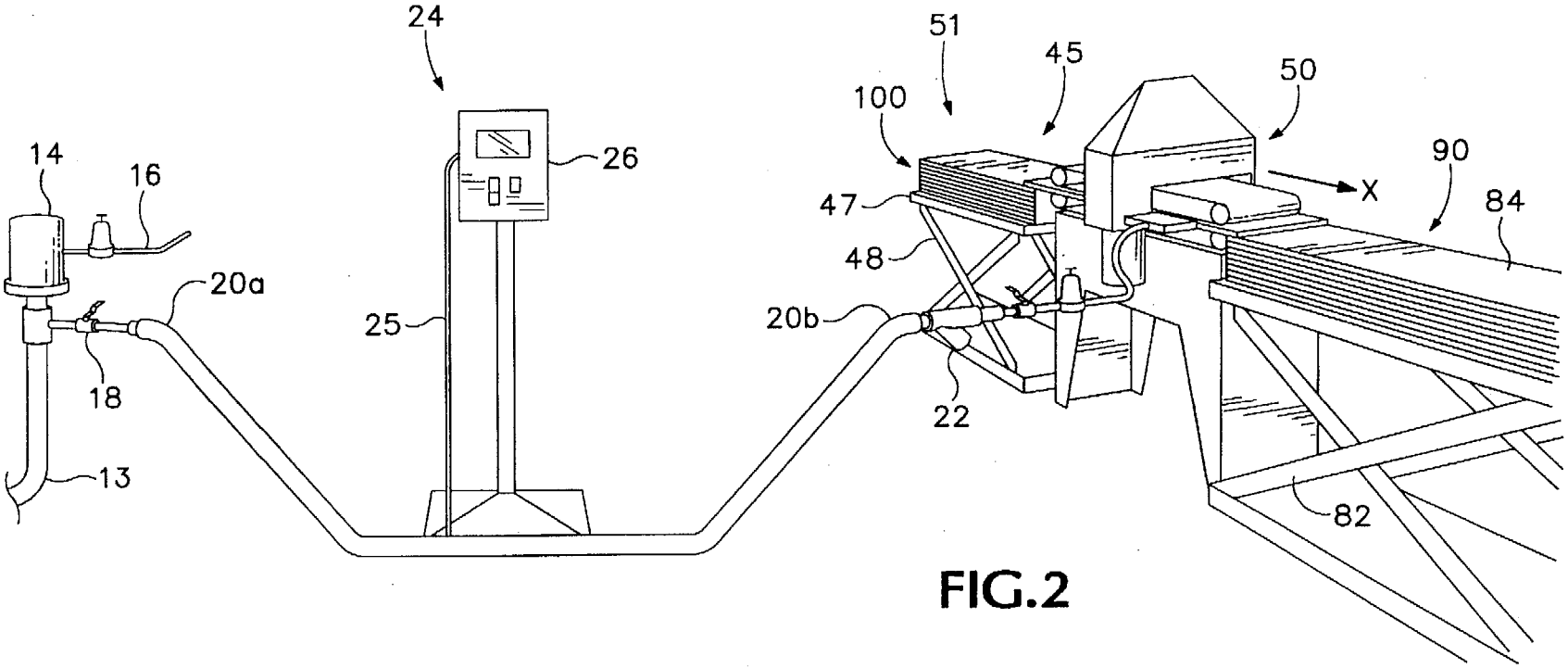
FIG. 2 is a schematic perspective representation of a system for continuously applying a substantially uniform and smooth coating of a water-based filler material to underlying wood substrates.
Figure 3:
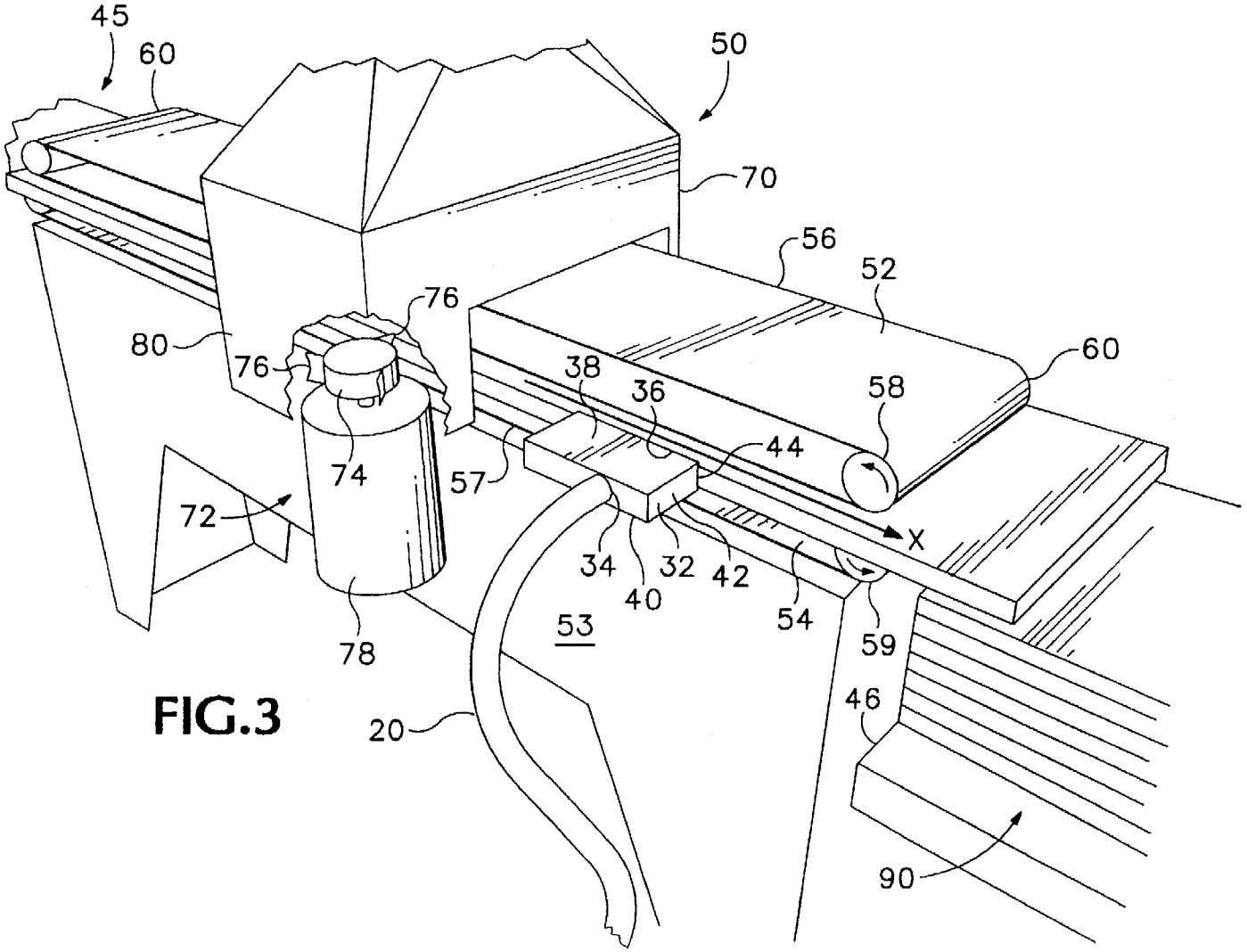
FIG. 3 is a schematic perspective representation of a filler material application system for continuously providing a water-based filler material to a wood substrate.

Referring now to FIGS. 1–3, a preferred process for continuously applying a substantially uniform and smooth filler of a water-based filler material to underlying wood substrates is shown.

Container 12 having the water-based filler material located therewithin, typically in the form of a tote or drum, is shown in FIG. 1. The requisite physical and chemical properties of the water-based filler material, which is typically a water-based putty material, are determined prior to manufacture so that they are manifested in the final product. These properties can include properties such as viscosity, total solids and product composition.

Container 12 of the water-based filler material is attached to a feed line 13, which in turn is joined to pump 14 which directs the filler material through trace line heater hose 20 for application to a wood substrate 100. The preferred pump 14 is an air pressure-type pump, such as a Graco Model No. 206-445 air pressure-type pump manufactured by Graco Company of Atlanta, Ga. The Graco pump has a 10:1 displacement ratio, 120 psi maximum working pressure and a typical working pressure of between about 35 and 70 psi, an infeed valve of about 1.5" npt and an out feed port of about 0.75" npt. Pump 14 includes a air regulator 16 which attached to the mill pressurized air supply and which acts to control the pressure output from the pump 14 to the water-based filler material and ultimately to the applicator head 32. An in-line control valve 18, typically a ball valve, which is located at the outlet of pump 14, turns on or off the flow of the water-based filler material to traceline heater hose 20.

The traceline heater hose 20 is connected at its inlet end **20*a* to in-line control valve 18. The preferred heater hose 20** is manufactured by Technical Heater Inc. of San Fernando, Calif., is 0.5" diameter and 16 feet long with 0.5" JIC fittings and a maximum working pressure of about 2500 psi.

The temperature of the water-based filler material is controlled within the confines of the traceline heater hose 20 by a heater control system 24. The preferred heater controller system 24 is a manufactured by The Willamette Valley Co. of Eugene, Oreg., 110 volt with a temperature range from 0 to 1200 degrees F. The preferred heater controller can maintain the filler at a constant temperature and can control the flow rate to the substrate by varying the temperature to change the filler material viscosity. System 24 comprises a control box 26 joined to traceline heater hose 20 by an electrical supply line 25 extending therebetween, and having a electrical line 29 connected to a source of electrical current (not shown). The control box 26 is manually operated by engaging or disengaging the thermostat switch 27 to increase or decrease the amount of heat imparted to the water-based filler material by the heater hose. Increasing the temperature of the heater controller system 24 will increase the heat generated by the traceline heater hose 20 which in turn will increase the temperature of the water-based filler material.

The traceline heater hose 20 is connected at its outlet end **20*b* to the inlet of a Y-type strainer filter 22. Filter 22 is coupled to a in-line valve 28, typically a ball valve, which in turn in attached to a fluid regulator 30 which is a Model No. 651-709-B, manufactured by ARO Company of Bryan, Ohio. In-line valve 28 controls the flow of water-based filler material to the fluid regulator 30, and fluid regulator 30 adjusts the amount of water-based filler material which flows to the applicator head 32 through heater hose 20**.

Applicator head 32 is a generally rectangular-shaped housing having a top 38, a bottom 40, sides 42, an inlet end 34 to which the heater hose 20 is coupled, and an outlet end 36 all of which defines an inner chamber (not shown) for receiving the water-based filler material. The outlet end 36 has a slot 44 located therewithin through which the water-based filler material fed to the inner chamber is applied to the wood substrate 100. Preferably, the applicator head 32 is an applicator smear head manufactured by Lawrence-David Inc. of Eugene, Oreg. All of the connections between the container 10, feed line 12, pump 14, in-line control valves 18 and 28, traceline heater hose, filter 22, fluid regulator 30 and applicator head 32, respectively, are made employing conventional attachment means.

The wood substrate feed system designated generally as "50" is designed to provide a wood substrate 100 having at least one routered edge on which the water-based filler material can be applied. The feed system 50 comprises an apparatus for moving a wood substrate 100 along a flow path designated "X" from infeed station 45 through successive routering to outfeed station 90. Filler material application operations to at least one routered edge of the wood substrate 100 will take place along the flow path.

Infeed station 45 typically comprises an x-lift table 46 for supporting and individually infeeding wood substrate 100 to feed system 51 from a stack of wood substrate 100 located on table 47. Table 47 is attached to and supported on an x-lift mechanism 48. X-lift mechanism 48 indexes a stack of wood substrate 100 located on table 47 upward to a predetermined height when the top wood substrate 100 is fed into the feed system 51 and is removed from the stack. The x-lift table maintains the stack in predetermined alignment with the feed system 51.

The feed system 51 comprises upper and lower drive conveyors 52 and 54 which comprise respective upper and lower continuous conveyor belts 56 and 57, the belts 56 and 57 wrapping around drive inlet rollers 58 and outlet rollers 59 located at the respective inlet and outlet ends 60 and 62 of the lower and upper drive conveyors 52 and 54, respectively. The feed system 51 is joined to and supported above ground level on frame member 53. The drive conveyor belts 56 and 57 move in a counterclockwise direction about rotating rollers 58 and 59. Roller 58 is rotated in a counterclockwise direction and roller 59 is rotated in a clockwise direction by drive motors (not shown). The lower and upper drive conveyors 52 and 54 together define an intermediate open area "X" located below the bottom of upper drive conveyor belt 52 and above the top of lower drive conveyor 54. The intermediate open area "X" acts as a flow path for feeding the wood substrates through the application area and onto a stacking station.

Figure 5:
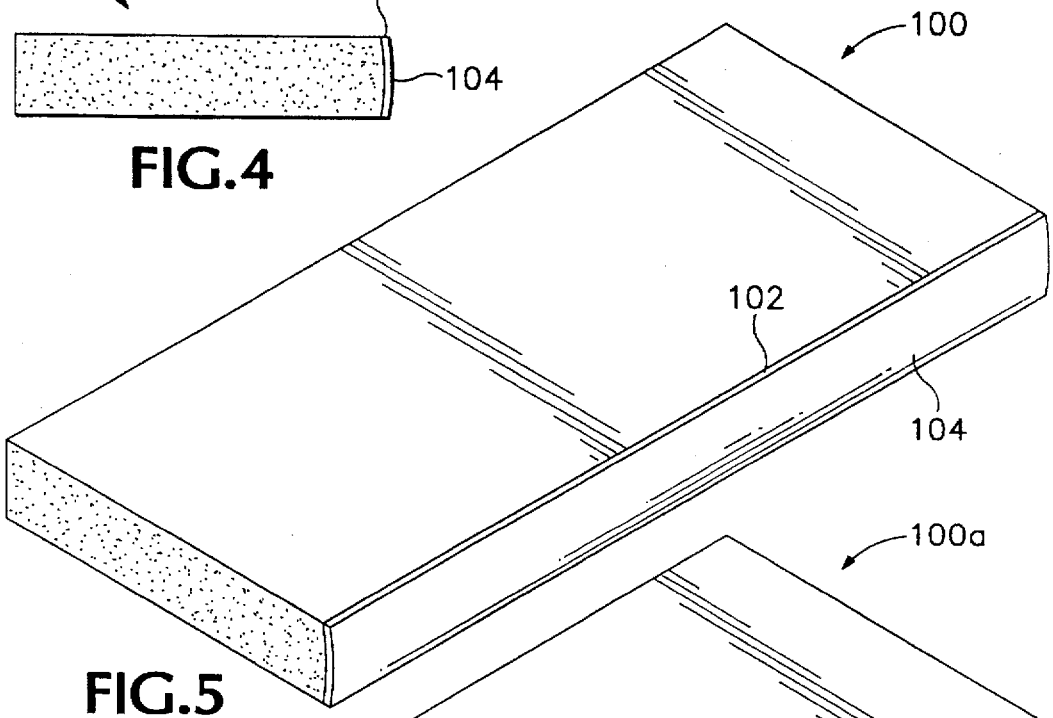
FIG. 5 is an end view of the particleboard panel of FIG. 4.
Figure 6:
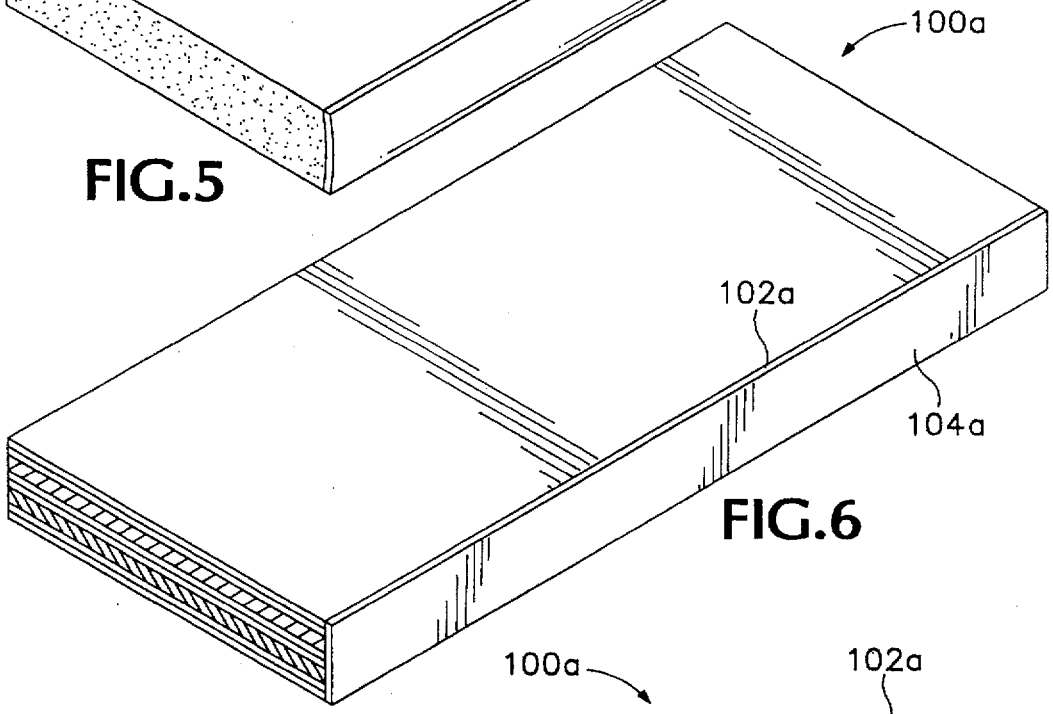
FIG. 6 is a perspective view of a plywood panel having a edge coated with a water-based filler material.
Figure 7:
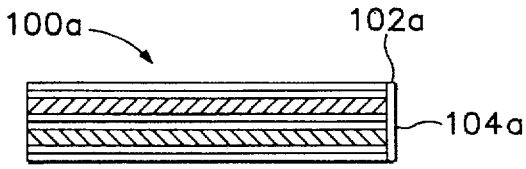
FIG. 7 is an end view of the plywood panel of FIG. 6.

The filler material application system 50 can include a router system 70 for imparting at least one routered edge to the wood substrate 100 depicted in FIGS. 5 and 6. The routering system 70 comprises a routering machine 72 having a revolving vertical spindle 74 and router cutting heads 76 for milling out the surface of the edge of the wood substrate 100. The router cutting heads 76 are driven by a router motor 78. For safety and environmental purposes, a vacuum hood 80 is installed in the system 50 which provides a protective shroud for routering system 70 for containing the wood particles produced during the routering operation thereby safeguarding the person acting as line tender during the filler material application process.

Applicator head 32 is coupled to frame member 53 using a conventional mounting bracket (not shown) at a point between the outlet of the routering system 50 and the outfeed station 90.

Outfeed station 90 typically comprises an x-lift table 46, similar in construction to outfeed station 45, for supporting wood substrate 100 that have been substantially uniformly and smoothly covered with the water-based filler material X-lift mechanism 82, in this instance, receives and stacks finished wood substrates on table 84. The x-lift table 84 maintains the stack in predetermined alignment with the feed system 51 by indexing a predetermined distance in a downward direction when successive finished wood substrates are stack one atop the other.

The wood substrates 100, prior to introduction into the edge routering and filler material application areas, are placed on x-lift table 46 using a fork lift or the like. Similarly, when the finished wood substrate 100 that are substantially uniformly and smoothly coated with a water-based filler material are fully stacked atop x-lift table 84, they are also removed using a fork lift or the like, and then stored for shipment to customers.

For example, a water-based filler material was provided in containers 12 at a predetermined viscosity, for continuous application to a wood substrate, employing system 10 of the present invention which was previously described. Pump 14 was connected by an operator known as a "line tender" to both the heater hose 20 and the container 12. The heater hose 20 was also connected to filter 22. Filter 22 was coupled to fluid regulator in-line valve 28, which in turn in attached to a fluid regulator 30 and application head 32. Next, the heater control system 24 was installed to the heater hose 20 and then plugged into a source of electrical current. The heater hose 20 was turned on and set at 100 degree F. for start-up purposes. Then, pump 14 was turned on, set at 45 psi, so that the water-based filler material flowed through the heater hose until it filled up the inner chamber of applicator head 32. About 2 gallons of water-based filler material was run through hose 20 and applicator head 32 to stabilize the temperature and to pressure and to pressure out air entrapped in the hose.

Figure 4:
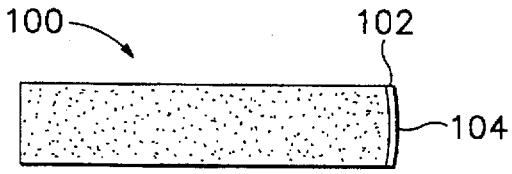
FIG. 4 is a perspective view of particleboard panel having a routered edge coated with a water-based flier material.

Wood substrate 100 was fed from infeed station 45 to feed system 50 where they were moved within intermediate area Y by respective upper and lower drive conveyors 52 and 54 acting together to impel, if desired, the wood substrates in a flow path to router system 70. Router cutting heads 76 milled out the surface of the edge of the wood substrate. When particleboard was used as the wood substrate, a routered edge was produced as shown in FIG. 4. However, when plywood was used as the wood substrate, a flat edge similar to the one depicted in FIG. 6 was produced. Therefore, the system can be operated with or without the routering step.

Water-based filler material was applied to the edge by applicator head 32 as the wood substrate was moved along flow path "X". In the system depicted, the edge is routered. The line tender adjusted the pressure and temperature within the heater hose 20 by adjusting respectively the pressure on pump 14 and by adjusting the current in electrical supply line 26 at heater control system 24. The line tender will visually inspect the coverage and smoothness of the filler material coating being imparted by applicator head 32 to the routered edge of the wood substrate. A wood substrate 100 comprising particleboard with a routered edge which has been appropriately covered with a filler material on a single edge is shown in FIG. 4, and a wood substrate comprising plywood with a routered edge which has been appropriately covered with filler material on a single edges is shown in FIG. 6. When the covering of filler material imparted to the wood substrates became unacceptable by visual inspection, the line tender adjusted the temperature and/or pressure to ultimately produce a wood substrate which was substantially uniformly and smoothly covered by the water-base filler material. This temperature and/or pressure adjustment was completed in a matter of seconds by the line tender.

Figure 8:
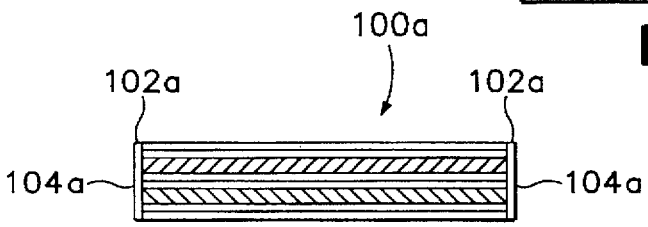
FIG. 8 is an end view of a plywood panel, similar to the panel depicted in FIGS. 6 and 7, having a pair of routered edges coated with a water-based filler material coated on each of the edges.

If desired, a system similar to system 10 can be provided on the opposite side of feed system 51 for purposes of continuous application of a water-based filler material to a second routered edge of a wood substrate. In the dual-sided application case, an end view of a plywood panel having a pair of sawed edges and having filler material applied to both edges is depicted in FIG. 8.

Having illustrated and described the principles of my invention in a preferred embodiment thereof, it should be readily apparent to those skilled in the art that the invention can be modified in arrangement and detail without departing from such principles. I claim all modifications coming within the spirit and scope of the accompanying claims.

I claim:

1. A process for continuously applying a substantially uniform and smooth filler of a water-based filler material to underlying wood substrates, which comprises:

providing said underlying wood substrates having an outer surface;

providing said water-based filler material having a total solids of at least about 70% by weight, based on the total weight of said filler material, and a Brookfield viscosity of at least about 100,000 cps;

introducing said underlying wood substrates into a filler application area;

determining the initial temperature of the outer surface of said underlying wood substrates prior to applying said water-based filler material, the initial temperature of said outer surface of said underlying substrate being from about 65 up to about 210 degrees F.;

determining the initial temperature of said water-based filler material prior to applying same to said underlying wood substrates, the initial temperature of the water-based filler material being from about 75 up to about 135 degrees F.;

continuously adjusting the temperature of said water-based filler material based on the temperature of the outer surface of said underlying wood substrate so that the temperature of the water-based filler material applied to the outer surface of said underlying wood substrate is maintained at an application temperature which will cause the water-based filler material to smoothly flow over and fill the contours of the outer surface of the underlying wood substrates, the smoothly flowing water-based filler material avoiding sag or shrinkage when applied to the underlying wood substrate, and the outer surface of the underlying wood substrate thereby being substantially uniformly and smoothly coated with said water-based filler material; and continuously applying the water-based filler material to the outer surface of the underlying wood substrates at the adjusted application temperature in the filler application area to form underlying wood substrates that are substantially uniformly and smoothly coated with said water-based filler material.

2. The process of claim 1, wherein said wood substrate comprises a composite wood product.

3. The process of claim 2, wherein the underlying composite wood product comprises particleboard, oriented strandboard, plywood, or waferboard.

4. The process of claim 1, wherein the initial temperature of the outer surface of said underlying wood substrates is from about 70 up to about 200 degrees F.

5. The process of claim 1, wherein the initial temperature of the outer surface of said underlying wood substrates is from about 75 degrees up to about 175 degrees F.

6. The process of claim 1, wherein the initial temperature of said water-based filler material is from about 80 degrees up to about 120 degrees F.

7. The process of claim 1, wherein the initial temperature of said water-based filler material is from about 85 degrees F. up to about 120 degrees F.

8. The process of claim 1, wherein said water-based filler material has a % total solids of at least about 75% by weight, based on the total weight of said water-based filler material.

9. The process of claim 1, wherein the application temperature of said water-based filler material is at least about 85 degrees F. up to about 200 degrees F.

10. The process of claim 1, wherein said water-based filler material in said application area has a Brookfield Viscosity of at least about 115,000 cps.

11. The process of claim 1, wherein said water-based filler material is applied to the edge of said underlying wood substrate.

12. The process of claim 1, wherein said water-based filler material is a water-based putty material.

13. The process of claim 1, wherein said filler material is applied to the underlying substrate at a thickness of up to about 28 wet mils.

14. The process of claim 11, wherein said substantially uniformly and smoothly coated underlying wood substrates can be stacked without substantial blocking within 60 seconds after said application step is completed.

15. The process of claim 11, wherein said filer material is applied in a single pass.

16. A process for continuously applying a substantially uniform and smooth filler of a water-based filler material to underlying wood substrates, which comprises providing said underlying wood substrates having an outer surface;

providing said water-based filler material at a % total solids of at least about 70% by weight, based on the total weight of the water-based filler material, and a Brookfield Viscosity of at least about 100,000 cps;

introducing said underlying wood substrates into a filler application area;

determining the temperature of the outer surface of said underlying wood substrates prior to applying said water-based filler material;

determining the temperature of said water-based filler material prior to applying same to said underlying wood substrates;

continuously adjusting the temperature of said water-based filler material, based on the temperature of the outer surface of said underlying wood substrate, as previously determined, so that the temperature of the water-based filler material applied to the outer surface of said underlying wood substrate is maintained at an application temperature of at least about 85 degrees F. up to about 200 degrees F.; and continuously applying the water-based filler material to the outer surface of the underlying wood substrates at the adjusted application temperature, in the filler application area, the so that the water-based filler material smoothly flows and fills the contours of the outer surface of the underlying wood substrates, thereby avoiding sag or shrinkage thereof on the underlying wood substrate to form underlying wood substrates that are substantially uniformly and smoothly covered with said water-based filler material.

17. The process of claim 16, wherein the underlying composite wood product comprises particleboard, oriented strandboard, plywood, or waferboard.

18. The process of claim 16, wherein the temperature of the outer surface of said underlying wood substrates is up to about 210 degrees F.

19. The process of claim 16, wherein the temperature of said water-based filler material is up to about 135 degrees F.

20. A process for continuously applying a substantially uniform and smooth filler of a water-based putty material to at least one edge of an underlying wood substrates, which comprises providing said underlying wood substrates including an outer surface having a plurality of edges;

introducing said underlying wood substrates into an application area;

determining the initial temperature of the outer surface of said underlying wood substrates prior to applying said water-based putty material, the initial temperature of the outer surface being from about 65 degrees F. up to about 210 degrees F.;

determining the temperature of said water-based putty material prior to applying same to said underlying wood substrates, the temperature of the water-based putty material being up from about 75 degrees F. to about 135 degrees F.;

continuously adjusting the temperature of said water-based putty material to an application temperature of from about 85 degrees F. up to about 200 degrees F., based on the previously determined temperature of the outer surface of said underlying wood substrate, and thereby continuously forming a smoothly flowing water-based putty material; and continuously applying the smoothly flowing water-based putty material to at least one of the edges of the underlying wood substrates, at the adjusted application temperature, in the filler application area, the smoothly flowing water-based putty material, on application, filling the contours of the edge of the underlying wood substrates, and also avoiding sag or shrinkage thereof on the edge of the underlying wood substrate to form underlying wood substrates having at least one edge which is substantially uniformly and smoothly coated with said water-based putty material.

21. The process of claim 20, wherein the initial temperature of said water-based filler material is from about 80 decrees F. up to about 125 degrees F.

22. The process of claim 20, wherein the initial temperature of said water-based filler material is from about 85 degrees F. up to about 120 degrees F.

23. The process of claim 20, wherein said water-based filler material in said application area has a % total solids of at least about 70% by weight, based on the total weight of said water-based filler material.

24. The process of claim 20, wherein the application temperature of said water-based filler material is from about 85 degrees F. up to about 200 degrees F.

25. The process of claim 20, wherein said water-based filler material in said application area has a Brookfield Viscosity of at least about 100,000 cps.

26. The process of claim 20, wherein said water-based filler material comprises calcium carbonate, ground lignocellulose, a polymeric suspension, and water.

27. The process of claim 20, wherein said filler material is applied to the underlying substrate at a thickness of up to about 28 wet mils.

28. The process of claim 20, wherein said substantially uniformly and smoothly coated underlying wood substrates can be stacked without substantial blocking within 60 seconds after said application step is completed.

29. The process of claim 20, wherein said filler material is applied in a single pass.

* * * * *